US009306287B2

(12) United States Patent
Chiang

(10) Patent No.: US 9,306,287 B2
(45) Date of Patent: Apr. 5, 2016

(54) ANTENNA STRUCTURE WITH AN EFFECTIVE SERIAL CONNECTING CAPACITANCE

(71) Applicant: Auden Techno Corp., Pa-Te, Tao-Yuan Hsien (TW)

(72) Inventor: Chi-Ming Chiang, Pa-Te (TW)

(73) Assignee: AUDEN TECHNO CORP., Pa-Te (TW)

( * ) Notice: Subject to any disclaimer, the term of this patent is extended or adjusted under 35 U.S.C. 154(b) by 314 days.

(21) Appl. No.: 14/074,818

(22) Filed: Nov. 8, 2013

(65) Prior Publication Data

US 2014/0091975 A1 Apr. 3, 2014

Related U.S. Application Data

(60) Division of application No. 12/510,380, filed on Jul. 28, 2009, now abandoned, which is a continuation-in-part of application No. 12/364,681, filed on Feb. 3, 2009, now abandoned.

(51) Int. Cl.

| | |
|---|---|
| ***H01Q 9/16*** | (2006.01) |
| ***H01Q 9/06*** | (2006.01) |
| ***H01Q 1/22*** | (2006.01) |
| ***H01Q 9/04*** | (2006.01) |

(52) U.S. Cl.
CPC ..... *H01Q 9/06* (2013.01); *H01Q 1/2266* (2013.01); *H01Q 9/0421* (2013.01)

(58) Field of Classification Search
CPC ..... H01Q 9/042; H01Q 9/06; H01Q 1/2266
See application file for complete search history.

(56) References Cited

U.S. PATENT DOCUMENTS

| | | | | |
|---|---|---|---|---|
| 6,297,776 | B1 * | 10/2001 | Pankinaho | H01Q 1/243 343/700 MS |
| 6,999,037 | B2 * | 2/2006 | Apostolos | H01Q 1/243 343/702 |
| 7,012,570 | B2 * | 3/2006 | Chen | H01Q 1/243 343/700 MS |
| 7,616,158 | B2 * | 11/2009 | Mak | H01Q 1/243 343/700 MS |
| 7,808,433 | B2 * | 10/2010 | Rutfors | H01Q 1/243 343/700 MS |
| 7,830,320 | B2 * | 11/2010 | Shamblin | H01Q 1/243 343/702 |
| 8,077,116 | B2 * | 12/2011 | Shamblin | H01Q 1/243 343/700 MS |
| 2003/0098812 | A1 * | 5/2003 | Ying | H01Q 1/243 343/702 |
| 2008/0129639 | A1 * | 6/2008 | Mitsugi | H01Q 1/243 343/876 |
| 2010/0019973 | A1 * | 1/2010 | Yang | H01Q 7/00 343/700 MS |
| 2011/0032170 | A1 * | 2/2011 | Chiang | H01Q 1/2266 343/860 |

* cited by examiner

*Primary Examiner* — Trinh Dinh
(74) *Attorney, Agent, or Firm* — Guice Patents PLLC

(57) ABSTRACT

In an antenna structure having a serial connected capacitance effect, mainly a metallic planar antenna is provided thereon at least with a first metallic plane board, and a second metallic plane board being close to but not connected to the first metallic plane board to form the effect of capacitance in serial connecting. And more, the antenna structure further has an extension arm made from a microstrip extended from the antenna or the second metallic plane board, and can be optionally grounded or not grounded, for the purpose of adjusting the impedance value of the antenna structure.

5 Claims, 11 Drawing Sheets

ANTENNA STRUCTURE WITH AN EFFECTIVE SERIAL CONNECTING CAPACITANCE

CROSS REFERENCE OF RELATED APPLICATIONS

This application is a Divisional of U.S. patent application Ser. No. 12/510,380 of the same inventor, filed on Jul. 28, 2009, which is a Continuation-In-Part of U.S. patent application Ser. No. 12/364,681 of the same inventor, filed on Feb. 3, 2009, now abandoned.

BACKGROUND OF THE INVENTION

1. Field of the Invention

The present invention is related to a brand new antenna structure, and especially to an antenna structure having a serial connected capacitance effect.

2. Description of the Prior Art

By fast development of communication techniques, mobile equipment are required to be compacted in volume, multi-frequency metallic planar antennas have become mainstream elements of mobile phones or notebooks for receiving or emitting radio signals.

Traditionally, metallic planar antennas are connected with circuit boards in mobile equipment via SMT elements. By virtue that normal SMT elements are designed to be impedances of fixed standard values, antennas still need matched electric circuits to adjust the values of capacitances and inductances, this may induce inconvenience of designing, and limit the frequency widths and effects of the antennas. Therefore, improvement is expected.

In a U.S. Pat. No. 6,542,123 titled "HIDDEN WIDEBAND ANTENNA" of the applicant, an inwardly recessed section, a back folded section and a protruding sheet extend out of an antenna for adjusting matching frequency. By the fact that the measures used in the patent makes elongation of the antenna to be unable to appropriately adjust values of capacitances and inductances, the designing of antennas still is limited.

SUMMARY OF THE INVENTION

Therefore, the present invention provides an antenna structure having a serial connected capacitance effect, wherein, mainly a metallic planar antenna is provided thereon at least with a first metallic plane board, and a second metallic plane board being close to but not connected to the first metallic plane board to form the effect of capacitance in serial connecting.

And more, the present invention further has an extension arm made from a microstrip extended from the antenna or the second metallic plane board, and can be optionally grounded or not grounded, for the purpose of adjusting the impedance value of the antenna structure.

The matching method for the antenna structure of the present invention is completed according to the principle of microstrip, such an antenna structure can make impedance matching to increase frequency width and efficiency, and allow adjustment of the values of electric inductance and capacitance at will; contrarily, a conventional antenna structure connected with SMT elements can only select impedance of a standard value. Therefore, the present invention has significant superiority in designing antennas.

Further, the present invention provides an antenna structure having a serial connected capacitance effect, wherein a second metallic plane board is composed of a feed-in metallic plane board and a grounding metallic plane board mutually connected by a communicating element provided between them. A feed-in point is extended out of the feed-in metallic plane board, while a grounding point is extended out of the grounding metallic plane board. Signals are fed in from the feed-in point of the second metallic plane board to form a capacitance effect by means of a layer of carrier plate sandwiched between the antenna and the second metallic plane board, to coupling transmit radio frequency signals from the feed-in point of the second metallic plane board to the antenna; and the communicating element can be optionally opened or closed, for the purpose of adjusting the frequency of the antenna structure.

In another antenna structure having a serial connected capacitance effect of the present invention, an antenna of the antenna structure having a serial connected capacitance effect is provided on its bottom with a grounding plane; the second metallic plane board has a feed-in metallic plane board and a connecting metallic plane board mutually connected by a communicating element provided between them. A feed-in point is extended out of the feed-in metallic plane board, while a connecting point is extended out of the connecting metallic plane board to connect a first metallic plane board of the antenna. Signals are fed in from the feed-in point of a second metallic plane board to form a capacitance effect by means of a layer of carrier plate sandwiched between the antenna and the second metallic plane board, to coupling transmit radio frequency signals from the feed-in point of the second metallic plane board to the antenna; and the communicating element can be optionally opened or closed, for the purpose of adjusting the frequency of the antenna structure.

The present invention will be apparent in its structure and effect after reading the detailed description of the preferred embodiment thereof in reference to the accompanying drawings.

DETAILED DESCRIPTION OF THE PREFERRED EMBODIMENT

Figure 1:
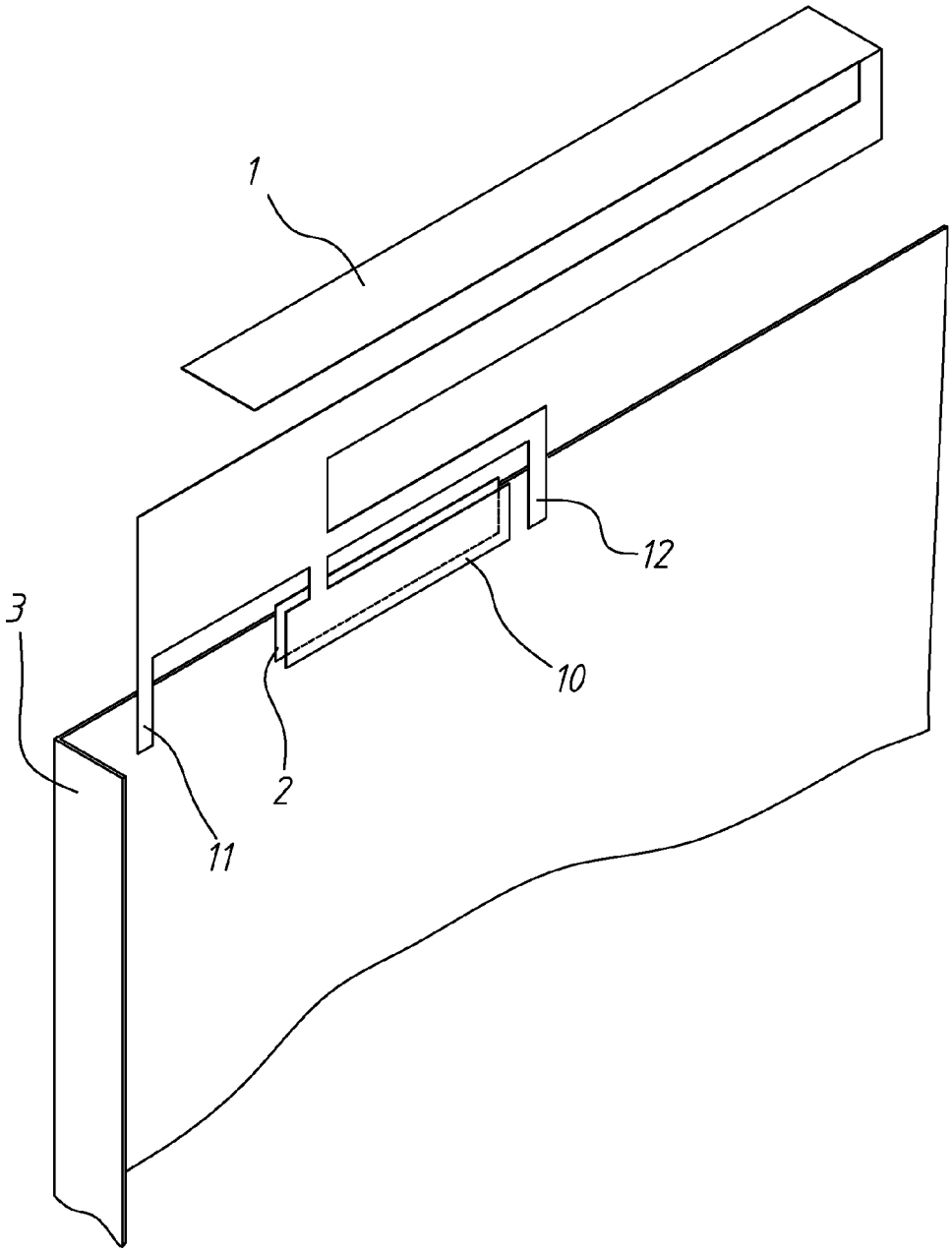
FIG. 1 is a perspective view showing the appearance of a first embodiment of the present invention.

Referring to FIG. 1 showing the first embodiment of antenna structure of the present invention, the antenna structure comprises an antenna 1 and a second metallic plane board 2 both provided on a circuit board 3 having a grounding surface.

The antenna 1 is a metallic planar antenna used to receive and emit radio signals, and has thereon a first metallic plane board 10. And the second metallic plane board 2 close to but not connected to the first metallic plane board 10 to form an effect of capacitance in serial connecting for the antenna structure. The second metallic plane board 2 can be not grounded.

And more, the antenna 1 further has an extension arm 11 extended therefrom for grounding, thereby the antenna structure forms an effect of inductance in parallel connecting, the antenna 1 forms a second extension arm 12 along the periphery of the first metallic plane board 10, the second extension arm 12 is not grounded to make an effect of inductance in parallel connecting. The first metallic plane board 10 and the second extension arm 12 can both be made from microstrips.

Figure 2:
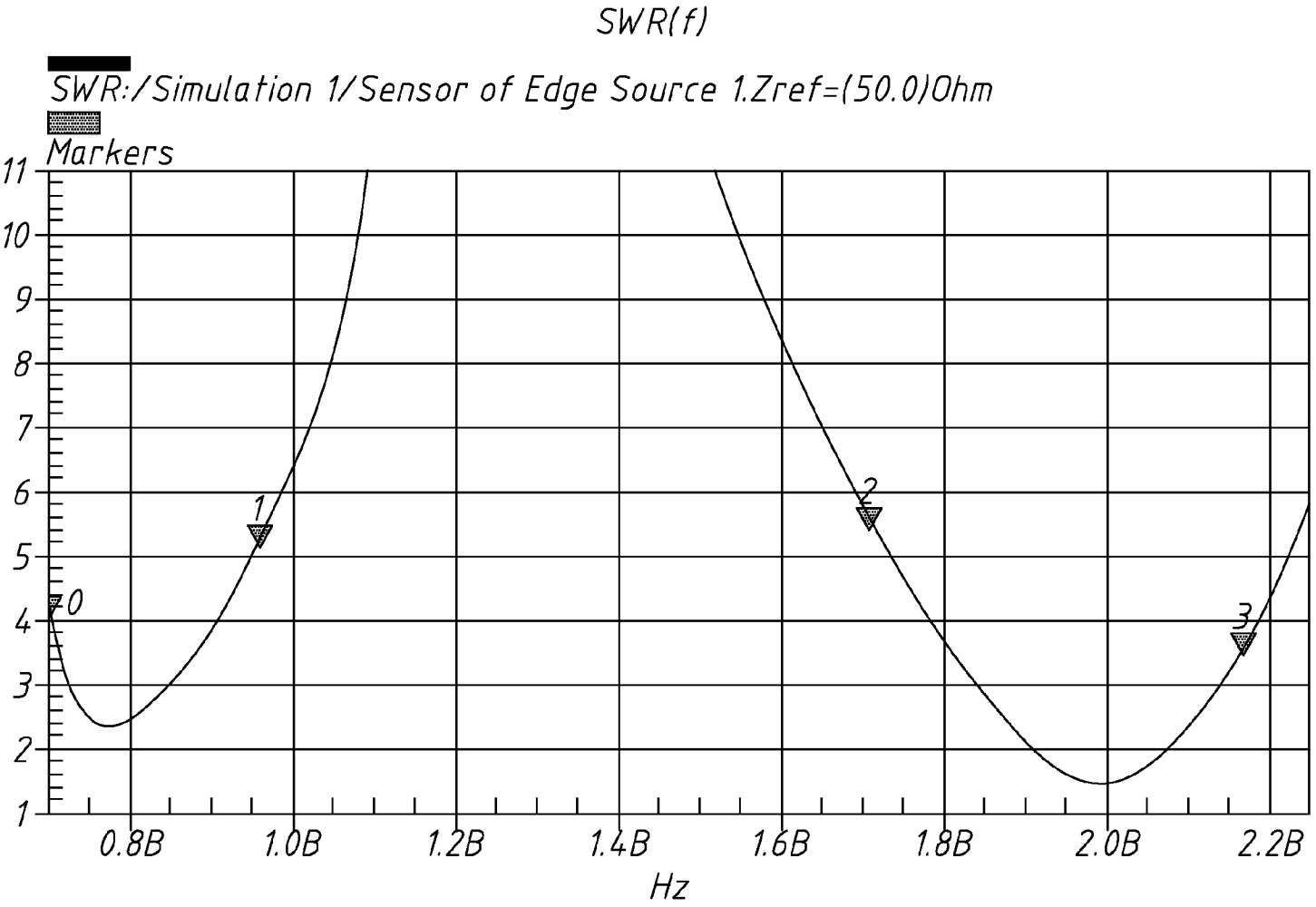
FIG. 2 is a chart showing standing wave voltage ratios of the first embodiment of FIG. 1.

FIG. 2 shows a standing wave voltage ratio chart of the embodiment of FIG. 1, and shows that the antenna structure is a good multi-frequency antenna structure.

Figure 3:
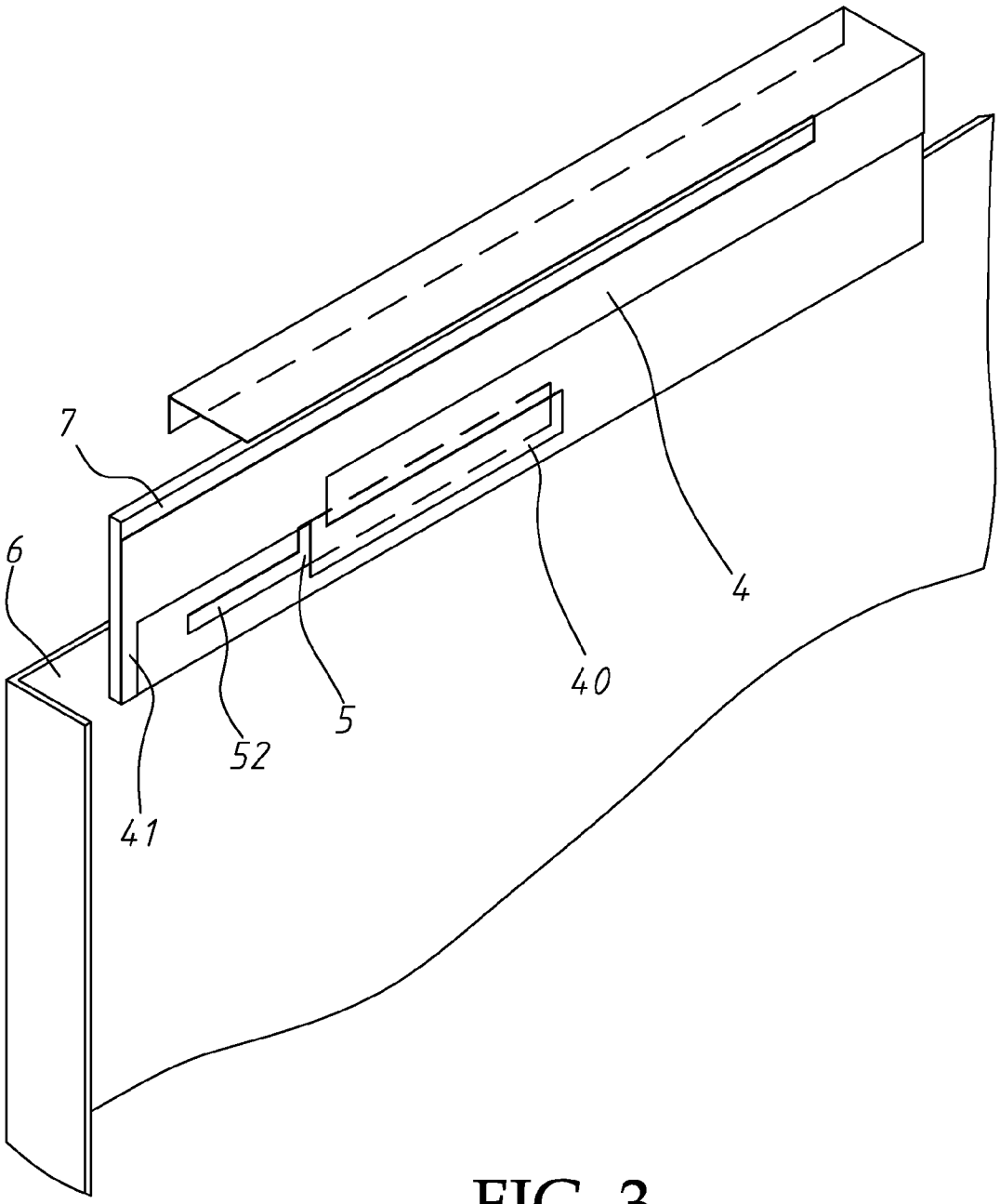
FIG. 3 is a perspective view showing the appearance of a second embodiment of the present invention.

Referring to FIG. 3 which shows a second embodiment of the present invention, similarly, the embodiment comprises an antenna 4 and a second metallic plane board 5 both provided on a circuit board 6 having a grounding surface.

The antenna 4 is a metallic planar antenna used to receive and emit radio signals, and has thereon a first metallic plane board 40. And the second metallic plane board 5 is close to but not connected to the first metallic plane board 40 to form an effect of capacitance in serial connecting for the antenna structure. The second metallic plane board 5 can be not grounded. The antenna 4 is provided on a printed electric circuit board 7, the first metallic plane board 40 and the second metallic plane board 5 are provided respectively on two surfaces of the printed electric circuit board 7.

Further, the antenna 4 has a first extension arm 41 extended therefrom for grounding, thereby the antenna structure forms an effect of inductance in parallel connecting. And the second metallic plane board 5 has a second extension arm 52 extended therefrom for grounding, thereby the antenna structure forms an effect of inductance in parallel connecting. The first metallic plane board 40 and the second extension arm 52 can both be made from microstrips.

Figure 4:
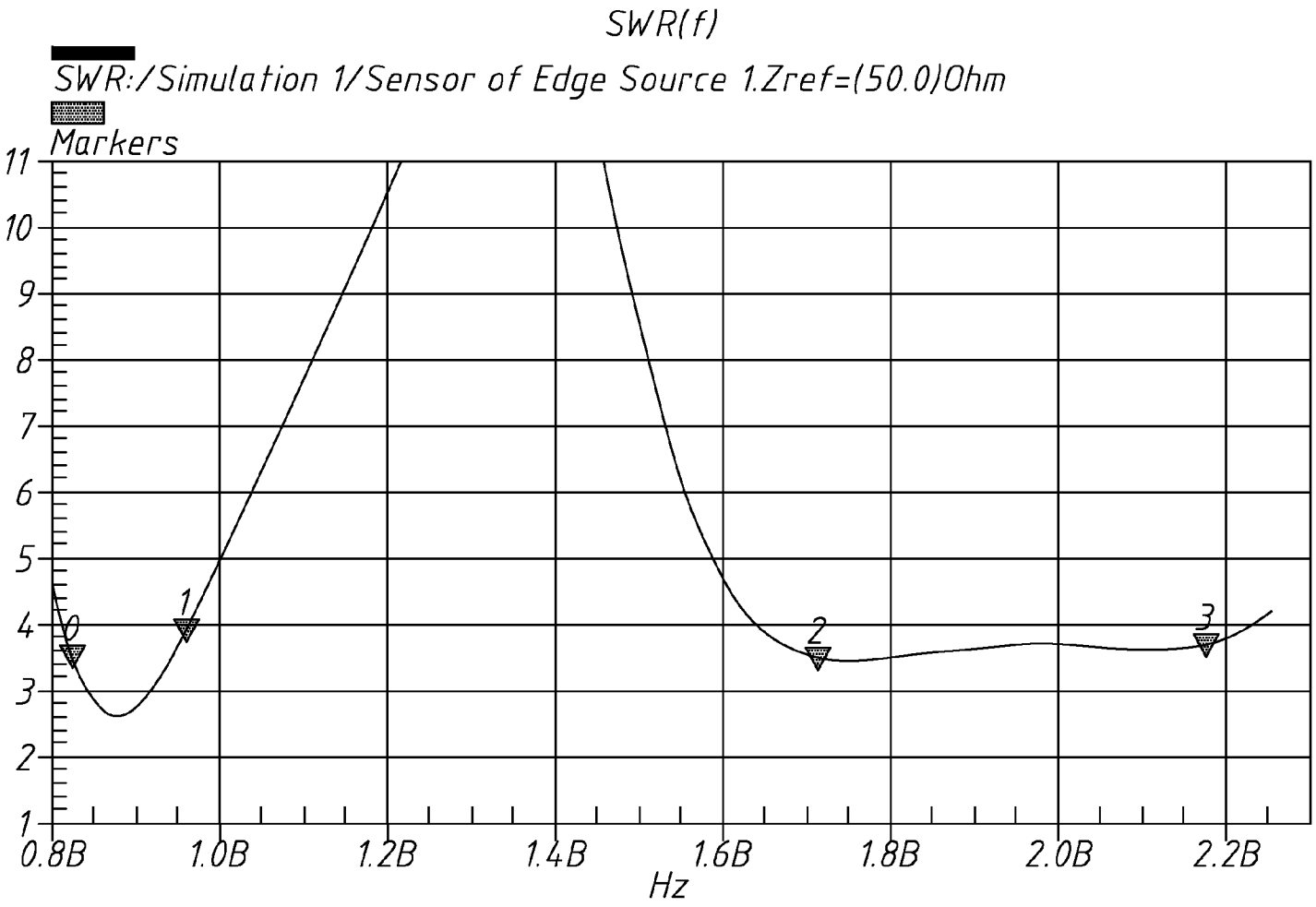
FIG. 4 is a chart showing standing wave voltage ratios of the second embodiment of FIG. 3.

FIG. 4 shows a standing wave voltage ratio chart of the embodiment of FIG. 3, and shows that the antenna structure is a good multi-frequency antenna structure.

It is evident that the present invention has the second metallic plane boards, the first and the second extension arms etc. all made from microstrips, so that the matching method for the antenna structure is completed according to the principle of microstrip, such that frequency width and efficiency can be increased, this allows adjustment of the values of electric inductance and capacitance at will; not like a conventional antenna structure connected with SMT elements that can only select impedance of a standard value. Therefore, the present invention has significant superiority in designing antennas.

Figure 5:
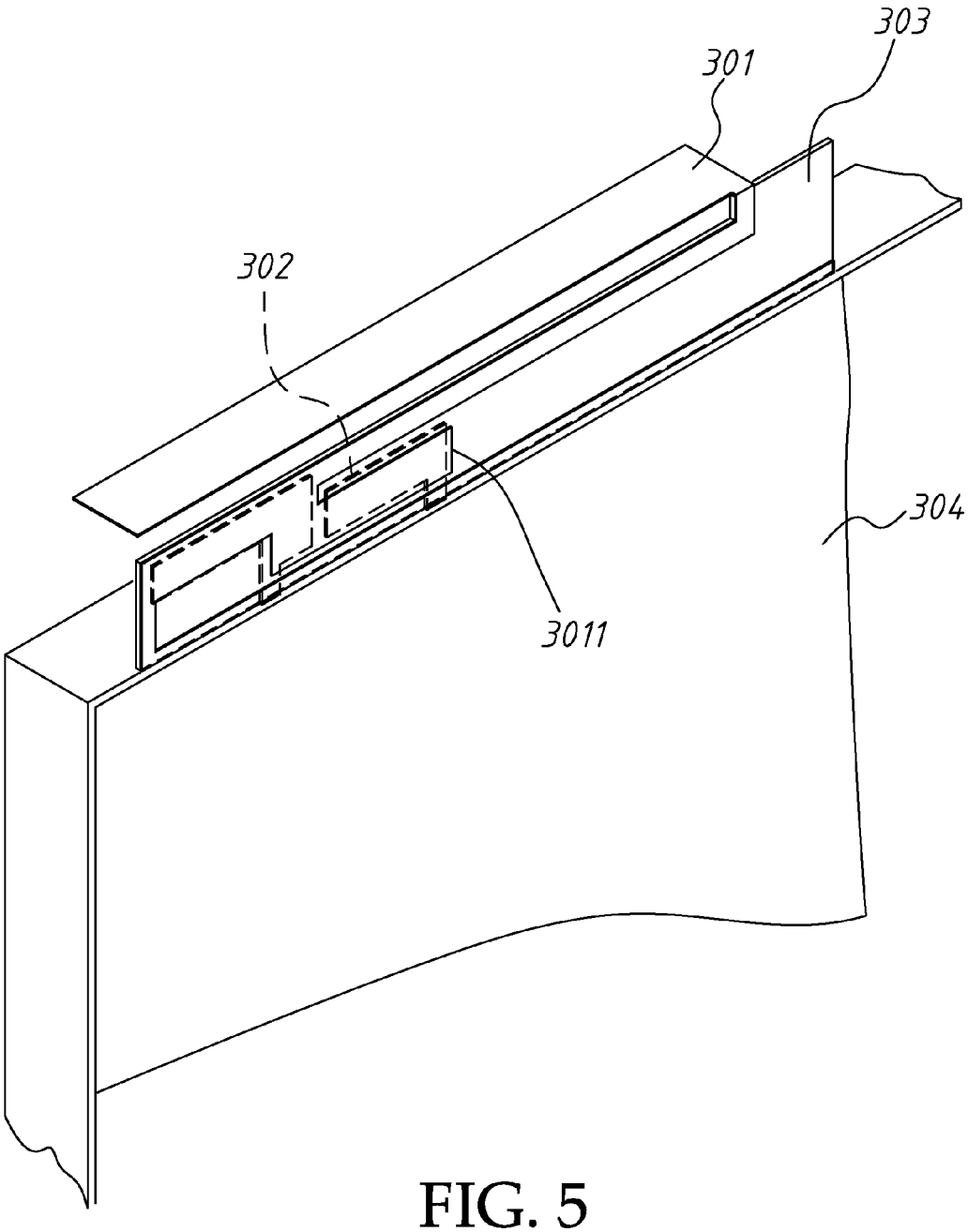
FIG. 5 is a perspective view showing a third embodiment of the present invention.
Figure 6:
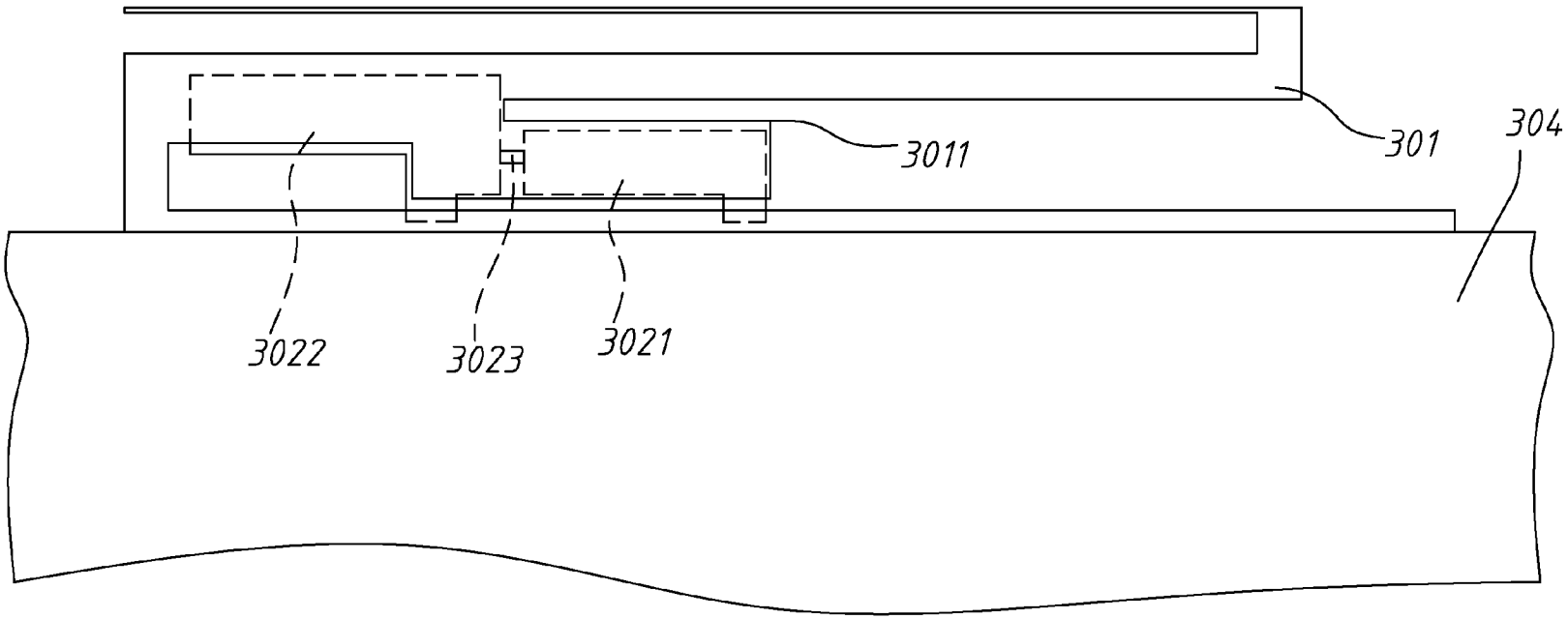
FIG. 6 is a front view of the third embodiment of the present invention, wherein a carrier plate is removed.
Figure 7:
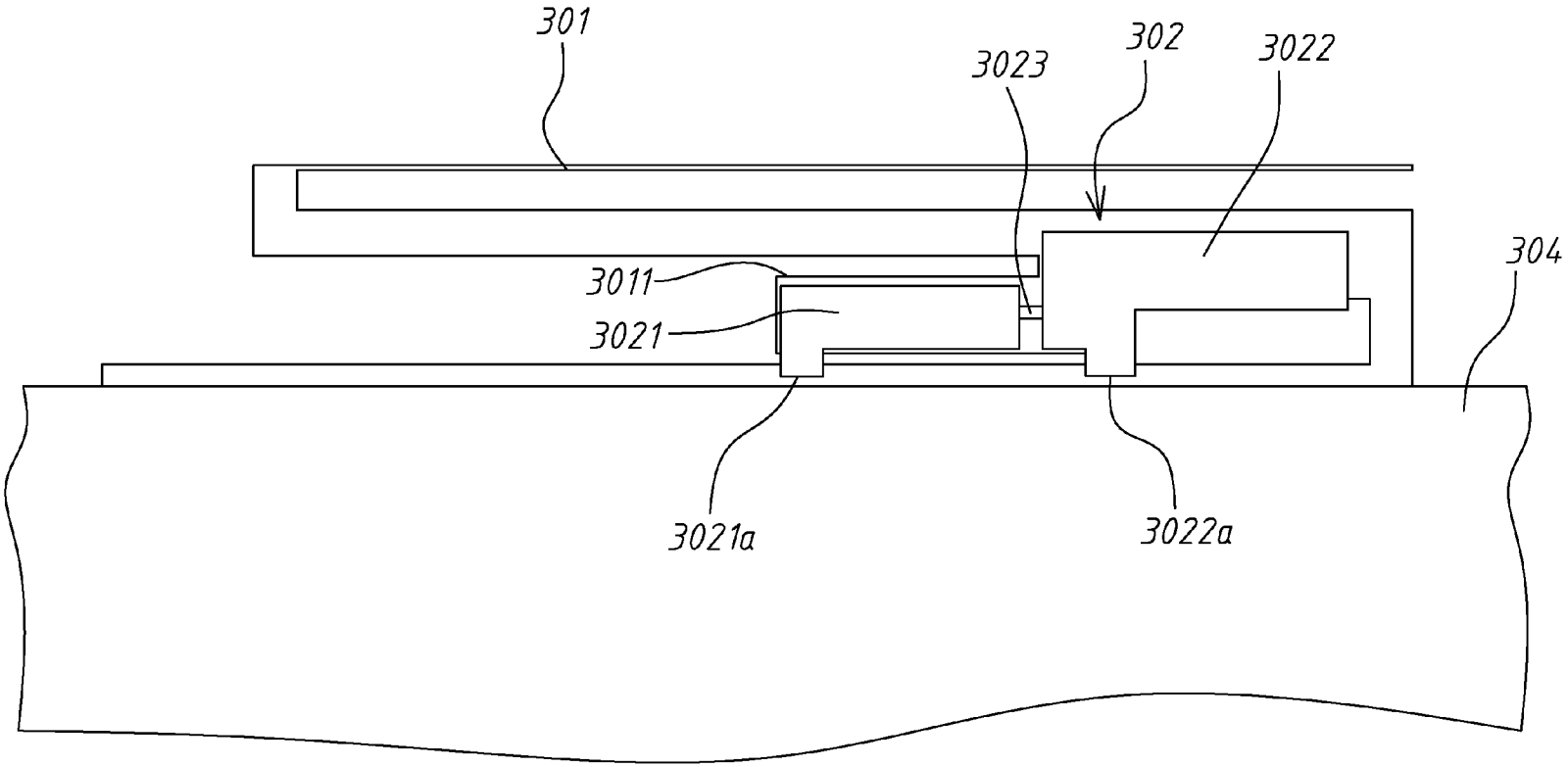
FIG. 7 is a rear view of the third embodiment of the present invention, wherein the carrier plate is removed.

Referring to FIGS. 5-7 showing a third embodiment of the antenna structure having a serial connected capacitance effect of the present invention, the antenna structure mainly comprises an antenna 301, a second metallic plane board 302 and a layer of carrier plate 303.

The antenna structure of the present invention is provided on a grounding plane 304.

The antenna 301 is provided on a front side of the layer of carrier plate 303, and is a metallic plane antenna for receiving or emitting radio signals, it is provided thereon at least with a first metallic plane board 3011.

The second metallic plane board 302 is provided on a rear side of the layer of carrier plate 303, therefore, it is expressed with dot lines as in FIGS. 5 and 6. The second metallic plane board 302 can be not grounded. The second metallic plane board 302 is provided near to the first metallic plane board 3011; Referring to FIG. 7, the second metallic plane board 302 has a feed-in metallic plane board 3021 and a grounding metallic plane board 3022 mutually connected by a communicating element 3023 provided between them. A feed-in point 3021*a* is extended out of the feed-in metallic plane board 3021, while a grounding point 3022*a* is extended out of the grounding metallic plane board 3022.

The layer of carrier plate 303 is sandwiched between the antenna 301 and the second metallic plane board 302, thereby the first metallic plane board 3011 and the second metallic plane board 302 are separated.

In the antenna structure of the present invention, signals are fed in from the feed-in point 3021*a* of the second metallic plane board 302 to form a capacitance effect by means of the layer of carrier plate 303 sandwiched between the antenna 301 and the second metallic plane board 302, to coupling transmit radio frequency (RF) signals from the feed-in point 3021*a* of the second metallic plane board 302 to the antenna 301.

In comparison with the first embodiment, the present invention is added with a communicating element 3023 which can be a diode or an adjustable capacitor. The communicating element 3023 can be used for optionally opening or closing, in order to adjust the frequency of the antenna structure.

Figure 8:
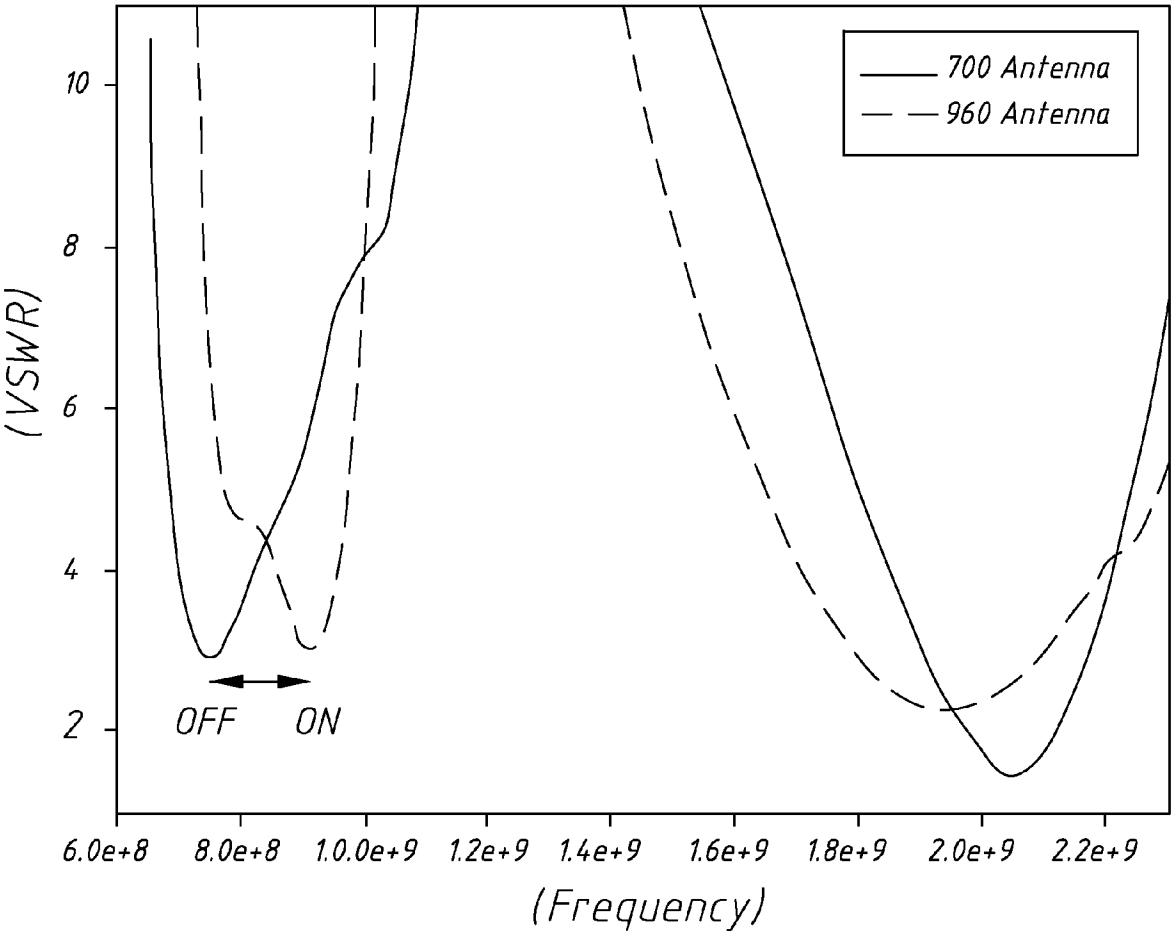
FIG. 8 is a chart showing standing wave voltage ratios of the third embodiment of the present invention.

Referring to FIG. 8, if the communicating element 3023 is a diode, the feed-in point 3021*a* has, not only RF signals, but also DC signals for the purpose of opening or closing of the diode. For example, when voltage is larger than 0.7 volt, the diode communicating element 3023 opens; on the contrary, when voltage is smaller than 0.7 volt, the communicating element 3023 closes. By having the character of opening or closing of the diode communicating element 3023, two different characters of standing wave are formed as shown in FIG. 8.

Certainly, the communicating element 3023 of the present invention can use any of various values capacitances for connecting end points respectively of the feed-in metallic plane board 3021 and the grounding metallic plane board 3022 on the rear side of the carrier plate 303, to thereby adjust the character of standing wave of the antenna.

In FIG. 8, the diode of the electric power source bias voltage communicating element 3023 is used to perform opening and closing of the feed-in metallic plane board 3021 and the grounding metallic plane board 3022 on the rear side, thereby two adjustable frequencies (700 MHz~824 MHz and 824 MHz~960 MHz) of the antenna are formed.

When using the adjustable feed-in metallic plane board 3021 and the grounding metallic plane board 3022 to open or close the communicating element 3023, the standing wave voltage ratio can be adjusted within the frequency range of ON (960 MHz) and OFF (700 MHz).

Figure 9:
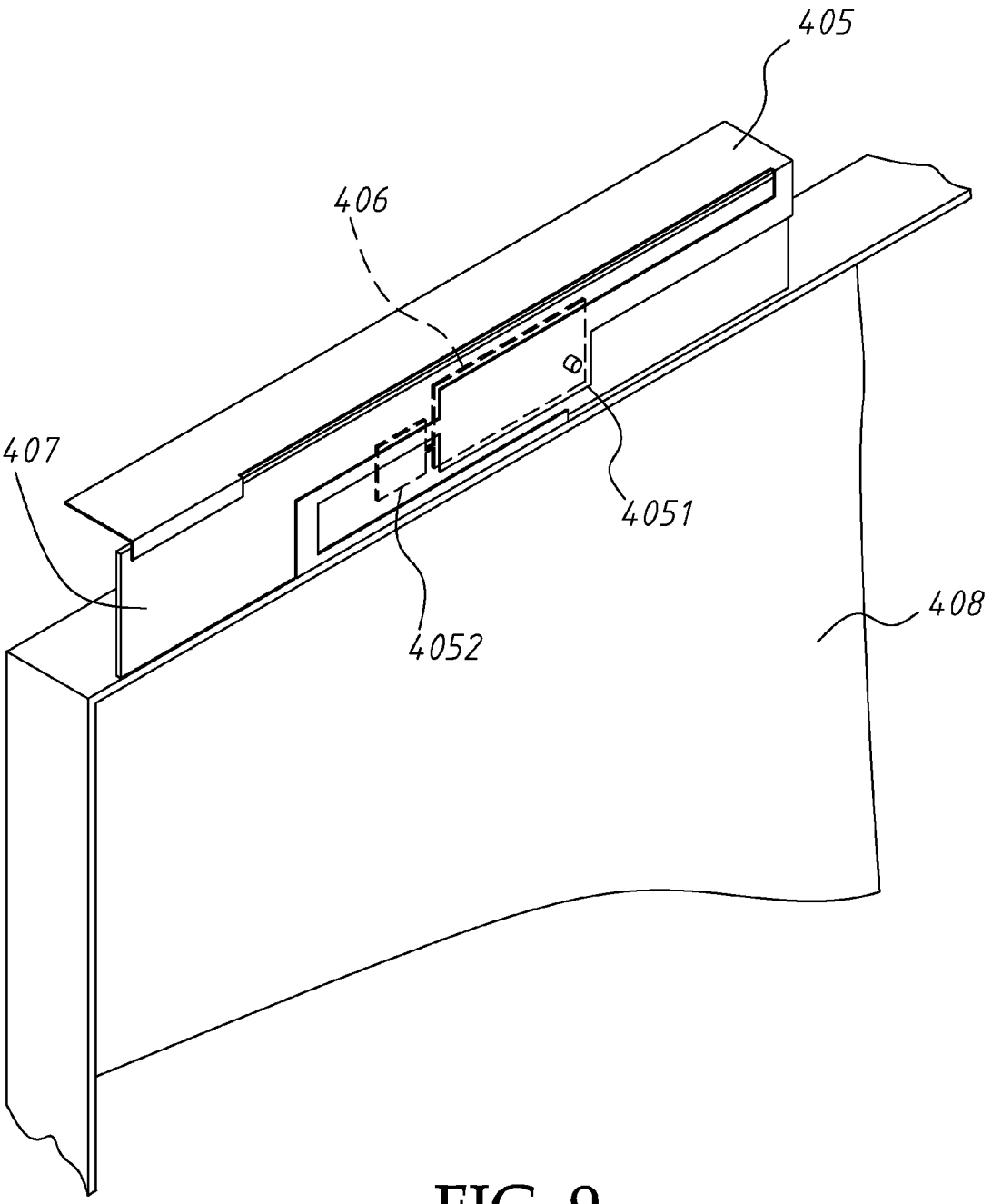
FIG. 9 is a perspective view showing the appearance of a fourth embodiment of the present invention.
Figure 10:
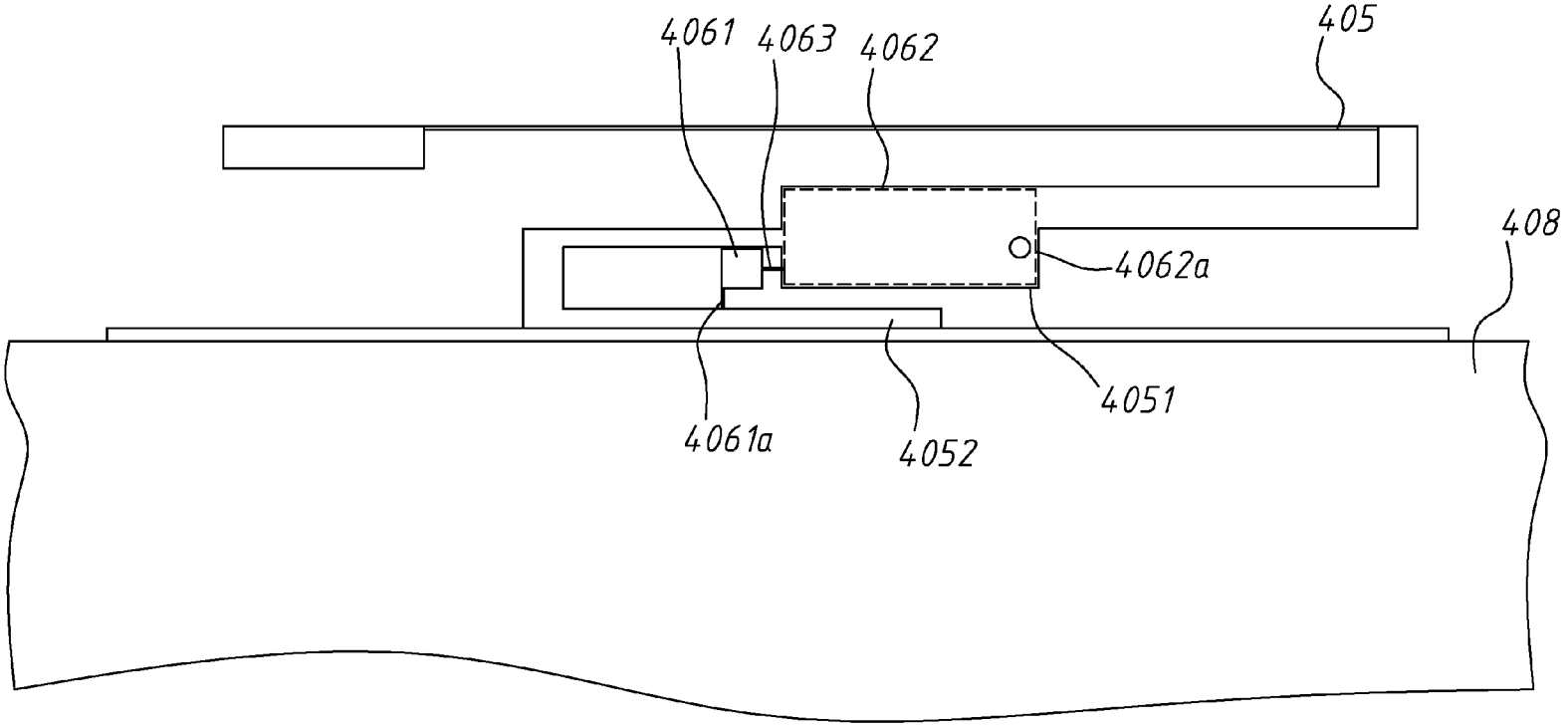
FIG. 10 is a front view of the fourth embodiment of the present invention, wherein a carrier plate is removed.

Further, please refer to FIGS. 9 and 10 showing a fourth embodiment of the antenna structure having a serial connected capacitance effect of the present invention, the antenna structure mainly comprises an antenna 405, a second metallic plane board 406 and a layer of carrier plate 407. The second metallic plane board 406 can be not grounded.

The antenna structure of the present invention is provided on a grounding plane 408.

The antenna 405 is provided on a front side of the layer of carrier plate 407, and is a metallic plane antenna for receiving or emitting radio signals, it is provided thereon with a first metallic plane board 4051 and is provided on its bottom with a grounding plane 4052.

The second metallic plane board 406 is provided on a front side of the layer of carrier plate 407; therefore, it is expressed with dot lines as in FIG. 9. The second metallic plane board 406 is provided near to the first metallic plane board 4051; Referring to FIG. 10, the second metallic plane board 406 has a feed-in metallic plane board 4061 and a connecting metallic plane board 4062 mutually connected by a communicating element 4063 provided between them. A feed-in point 4061*a* is extended out of the feed-in metallic plane board 4061, while a connecting point 4062*a* is extended out of the connecting metallic plane board 4062 which is extended through the carrier plate 407 to connect the a first metallic plane board 4051 of the antenna 405.

The layer of carrier plate 407 is sandwiched between the antenna 405 and the second metallic plane board 406, thereby the first metallic plane board 4051 and the second metallic plane board 406 are separated.

In the third embodiment of antenna structure of the present invention, signals are fed in from the feed-in point 4061*a* of the second metallic plane board 406 to form a capacitance effect by means of the layer of carrier plate 407 sandwiched between the antenna 405 and the second metallic plane board 406, to coupling transmit radio frequency (RF) signals from the feed-in point 4061*a* of the second metallic plane board 406 to the antenna 405.

Figure 11:
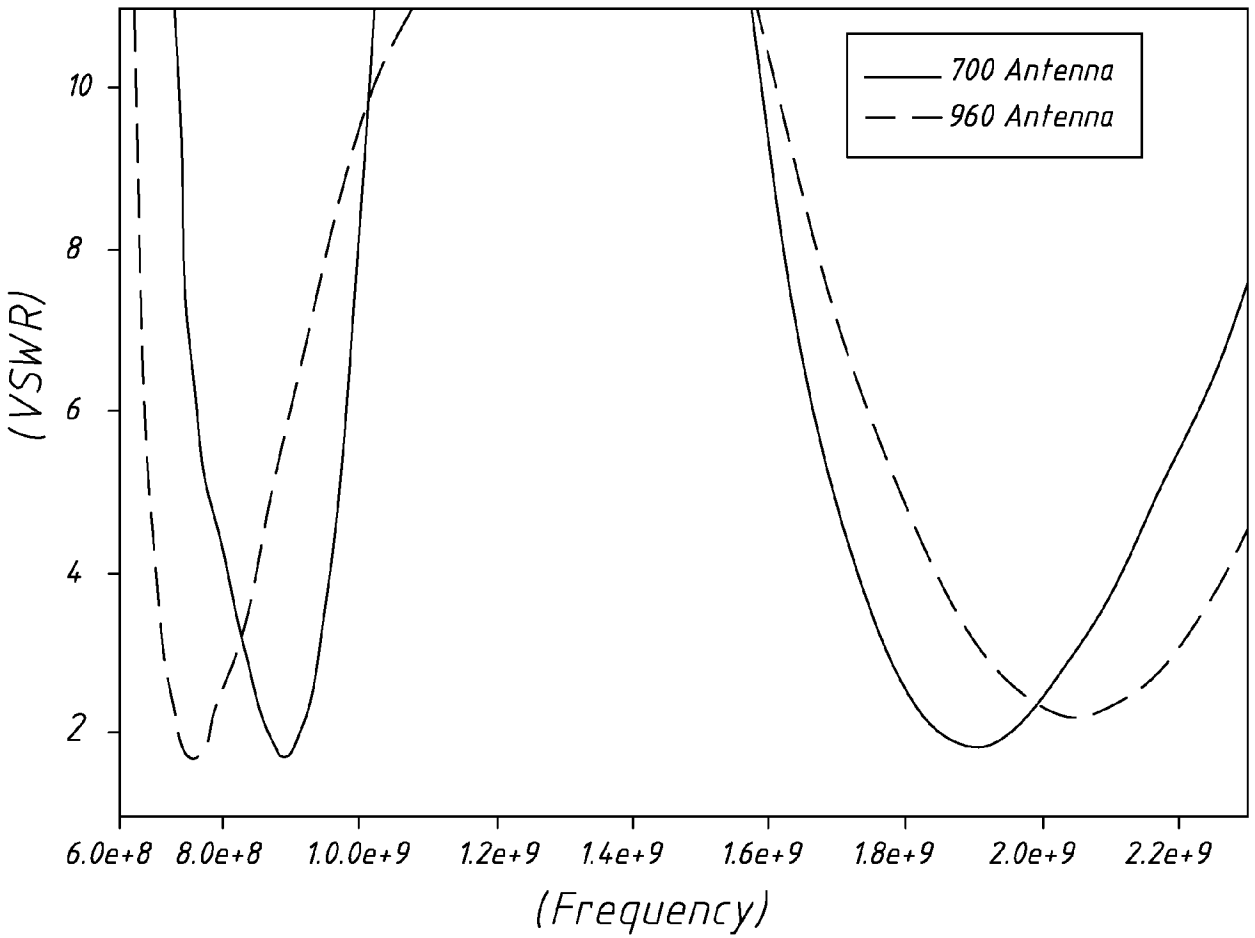
FIG. 11 is a chart showing standing wave voltage ratios of the fourth embodiment of the present invention.

Referring to FIG. 11 showing too the fourth embodiment of the present invention, wherein the communicating element 4063 can be an adjustable capacitor. The communicating element 4063 can be used for optionally opening or closing, in order to adjust the frequency of the antenna structure.

The adjustable capacitor, namely the communicating element 4063, can use two end points to adjust the character of standing wave of the antenna; as shown in FIG. 11, the standing wave within the frequency range of ON (960 MHz) and OFF (700 MHz) is adjustable.

The preferred embodiments disclosed above are only for illustrating the present invention. It will be apparent to those skilled in this art that various modifications or changes made to the elements of the present invention without departing from the spirit of this invention shall also fall within the scope of the appended claims and are intended to form part of this invention.

The invention claimed is:

1. An antenna structure having a serial connected capacitance effect comprising:

an antenna being a metallic planar antenna used to receive and emit radio signals, and the antenna has at least a first metallic plane board not positioned on the metallic planar antenna; and a second metallic plane board close to said first metallic plane board, said second metallic plane board has a feed-in metallic plane board and a grounding metallic plane board mutually connected by a communicating element provided between them; a feed-in point is extended out of said feed-in metallic plane board, while a grounding point is extended out of said grounding metallic plane board; and a layer of carrier plate is sandwiched between said antenna and said second metallic plane board, the second metallic plane board is not grounded;

signals are fed in from said feed-in point of said second metallic plane board to form a capacitance effect by means of said layer of carrier plate sandwiched between said antenna and said second metallic plane board, to coupling transmit radio frequency (RF) signals from said feed-in point of said second metallic plane board to said antenna;

and said communicating element is adapted to open or close for purpose of adjusting frequency of said antenna structure.

2. The antenna structure having the serial connected capacitance effect as defined in claim 1, wherein said communicating element is a diode, said feed-in point has RF signals and DC signals for the purpose of opening or closing of said diode.

3. The antenna structure having the serial connected capacitance effect as defined in claim 1, wherein said communicating element is an adjustable capacitor.

4. An antenna structure having a serial connected capacitance effect comprising:

an antenna being a metallic planar antenna used to receive and emit radio signals, and has at least a first metallic plane board not positioned on the metallic planar antenna; and the antenna is provided on a bottom with a grounding plane;

a second metallic plane board close to said first metallic plane board, said second metallic plane board has a feed-in metallic plane board and a grounding metallic plane board mutually connected by a communicating element provided between them; a feed-in point is extended out of said feed-in metallic plane board, while a connecting point is extended out of said connecting metallic plane board to connect said first metallic plane board of said antenna, the second metallic plane board is not grounded; and a layer of carrier plate is sandwiched between said antenna and said second metallic plane board;

signals are fed in from said feed-in point of said second metallic plane board to form a capacitance effect by means of said layer of carrier plate sandwiched between said antenna and said second metallic plane board, to coupling transmit radio frequency (RF) signals from said feed-in point of said second metallic plane board to said antenna;

and said communicating element is adapted to open or close for purpose of adjusting frequency of said antenna structure.

5. The antenna structure having the serial connected capacitance effect as defined in claim 4, wherein said communicating element is an adjustable capacitor.

* * * * *